US007992483B2

(12) United States Patent
Tseng

(10) Patent No.: US 7,992,483 B2
(45) Date of Patent: Aug. 9, 2011

(54) FIRING FREQUENCY CONTROLLER

(76) Inventor: Shu-Mei Tseng, Chung Ho (TW)

( * ) Notice: Subject to any disclaimer, the term of this patent is extended or adjusted under 35 U.S.C. 154(b) by 234 days.

(21) Appl. No.: 12/484,292

(22) Filed: Jun. 15, 2009

(65) Prior Publication Data

US 2010/0212648 A1 Aug. 26, 2010

(30) Foreign Application Priority Data

Feb. 24, 2009 (TW) ..... 98202698 U

(51) Int. Cl.
*F41A 3/78* (2006.01)
*F41A 19/03* (2006.01)
*F41A 5/30* (2006.01)

(52) U.S. Cl. ..... 89/130; 124/65

(58) Field of Classification Search ..... 89/130, 89/191.01, 191.02, 192, 193; 124/65
See application file for complete search history.

(56) References Cited

U.S. PATENT DOCUMENTS 3,598,016 A * 8/1971 Chiabrandy et al. ..... 89/157
3,618,457 A * 11/1971 Miller ..... 89/185
3,650,177 A * 3/1972 Hupp et al. ..... 89/130
3,953,213 A * 4/1976 Gasper ..... 277/438
4,303,138 A * 12/1981 Bassinger ..... 175/296
4,481,805 A * 11/1984 Dobesh ..... 73/1.17
5,272,956 A * 12/1993 Hudson ..... 89/128
5,351,598 A * 10/1994 Schuetz ..... 89/185
6,668,478 B2 * 12/2003 Bergstrom ..... 42/1.06
7,213,498 B1 * 5/2007 Davies ..... 89/198
7,832,326 B1 * 11/2010 Barrett ..... 89/191.01

* cited by examiner

*Primary Examiner* — Troy Chambers
(74) *Attorney, Agent, or Firm* — McGinn IP Law Group, PLLC

(57) ABSTRACT

A firing frequency controller which includes a cylinder body, a piston assembly, and a unidirectional seal is provided. The cylinder body includes a first orifice, a second orifice and a third orifice, wherein the gas flux through the first orifice and the third orifice are inequality. The piston assembly disposed inside said cylinder body is repeatedly moved. The unidirectional seal is disposed at outside of the piston and adjacent to the inner wall of the cylinder body. The unidirectional seal is contacted with the cylinder body and is kept airtight while moved at one direction. The unidirectional seal is not contacted with the cylinder body and kept non-airtight while moved at another direction. Because of pressure difference, the velocity of piston assembly can be adjusted and then the firing frequency of toy gun can be controlled.

14 Claims, 10 Drawing Sheets

FIRING FREQUENCY CONTROLLER

FIELD OF THE INVENTION

The present invention relates to a firing frequency controller, and particularly to a firing frequency controller which is used in a toy gun having the capability of automatic firing.

DESCRIPTION OF THE PRIOR ART

These days many people are very busy in their work. Leisure activities become very important for people to unwind and recharge so that they can face more challenges in their work. Leisure activities are diversified, and many choices are available to suit individual's tastes and preferences. For instance, outdoor excursion, seeing movies, shopping and the like can help people to reduce tension. Some people prefer more exciting activities to release the internal pressure, such as thrilling games in theme parks, glider riding, bungee jumping or the like. In recent years a new type of game has been introduced, namely "Survival game". In the game players have to equip with comprehensive outfits to prevent accidents. Each person also is provided with a toy gun and a plurality of projectiles. The projectile may be a capsule containing pigments. This game is quite popular, not only because it is exciting, but also mainly the toy gun used in the game almost like a real one in terms of shooting accuracy, shooting range, look and weight. Hence it gives people thrill like being plunged in a real battlefield.

In order to meet this demand, designing a toy gun which is capable of adjusting its firing frequency has become the most concern issue among manufacturers. The toy gun sold in market in these days includes a variety of linkage, spring, O-ring etc, in order to facilitate projectile firing and game progressing. However, automatic firing frequency of most toy guns can not be adjusted, in another words the amount of firing projectile per minutes is invariable in the mode of automatic firing. Because for some country the firing frequency in the survival game is generally restricted in assigned range, the toy gun whose firing frequency isn't conformed and unable to be adjusted will not be sold in these country.

Therefore, how to adjust the firing frequency of toy gun in the mode of automatic firing is an issue remained to be resolved in the industry.

SUMMARY OF THE INVENTION

The primary object of the invention is to provide a firing frequency controller for adjusting the firing frequency of toy gun in the mode of automatic firing.

To achieve the foregoing and other objects, a firing frequency controller is provided. The firing frequency controller comprises a cylinder body, a piston assembly, and a unidirectional seal. The cylinder body includes a first end portion and a second end portion. Said first end portion contains a first orifice and said second end portion contains a third orifice. Said cylinder body further includes a second orifice disposed between said first orifice and said third orifice. The amount of the gas flux through the first orifice is not equal to that through the third orifice. The piston assembly, disposed inside said cylinder body, includes a piston and a pole. Said piston is repeatedly moved between the first end portion and the second end portion. Said pole is connected to the piston and extended to exterior of the first end portion of the cylinder body. The stroke from the first orifice to the second orifice, the stroke from the second orifice to the third orifice, the stroke from the third orifice to the second orifice, and the stroke from the second orifice to the first orifice are defined as first route, second route, third route, and fourth route respectively. The unidirectional seal is disposed at outside of said piston and adjacent to the inner wall of the cylinder body. Said unidirectional seal is contacted with the inner wall of the cylinder body and is kept airtight when the piston moves in the third route and the fourth route. Said unidirectional seal is not contacted with the inner wall of the cylinder body and is kept non-airtight when the piston is moved in the first route and the second route.

In the aforementioned firing frequency controller, wherein the diameter of said third orifice is smaller than the diameter of said first orifice so as to keep the amount of the gas flux through the third orifice less than that through the first orifice, and then the speed of said piston in the third route becomes slower. Or, the diameter of said first orifice is smaller than the diameter of said third orifice so as to keep the amount of the gas flux through the first orifice less than that through the third orifice, and then the speed of said piston in the fourth route becomes slower.

In the aforementioned firing frequency controller, wherein a flux regulator is disposed in the third orifice to regulate the gas flux and to keep the amount of the gas flux through the third orifice less than that through the first orifice, and then the speed of said piston in the third route becomes slower. Or, a flux regulator is disposed in the first orifice to regulate the gas flux and to keep the amount of the gas flux through the first orifice less than that through the third orifice, and then the speed of said piston in the fourth route becomes slower.

To achieve the foregoing and other objects, another firing frequency controller is provided. The firing frequency controller comprises a cylinder body, a piston assembly, and a unidirectional seal. The cylinder body includes a first end portion and a second end portion. Said first end portion contains a first orifice and said second end portion contains a third orifice. Said cylinder body further includes a second orifice disposed between said first orifice and said third orifice. The amount of the gas flux through the first orifice is not equal to that of the third orifice. The piston assembly, disposed inside said cylinder body, includes a piston and a pole. Said piston is repeatedly moveable between the first end portion and the second end portion; said pole connects to the piston and extends to exterior of the first end portion of the cylinder body. The stroke from the first orifice to the second orifice, the stroke from the second orifice to the third orifice, the stroke from the third orifice to the second orifice, and the stroke from the second orifice to the first orifice are defined as first route, second route, third route, and fourth route respectively. The unidirectional seal is disposed at outside of said piston and adjacent to the inner wall of the cylinder body. Said unidirectional seal is contacted with the inner wall of the cylinder body and is kept airtight when the piston is moved in the first route and the second route. Said unidirectional seal is not contacted with the inner wall of the cylinder body and is kept non-airtight when the piston is moved in the third route and the fourth route.

In the aforementioned another firing frequency controller, the diameter of said third orifice is smaller than the diameter of said first orifice so as to keep the amount of the gas flux through the third orifice less than that through the first orifice, and then the speed of said piston in the second route. Or, the diameter of said first orifice is smaller than the diameter of said third orifice so as to keep the amount of the gas flux through the first orifice less than that through the third orifice, and then the speed of said piston in the first route becomes slower.

In the aforementioned another firing frequency controller, a flux regulator is disposed in the third orifice to regulate the gas flux and to keep the amount of the gas flux through the third orifice less than that through the first orifice, and then the speed of said piston in the second route becomes slower. Or, a flux regulator is disposed in the first orifice to regulate the gas flux and to keep the amount of the gas flux through the first orifice less than that through the third orifice, and then the speed of said piston in the first route becomes slower.

In the aforementioned firing frequency controller, the unidirectional seal is annular and includes a flexible branch disposed outside. Along with the gas flow said branch approaches the axis of the unidirectional seal or separates from the axis of the unidirectional seal.

In the aforementioned firing frequency controller, a first sealing element is disposed at the contact area of said first end portion and said pole.

The present invention of firing frequency controller can be accommodated to various toy guns with diversified configuration, so the firing frequency of the toy gun with the firing frequency controller can be adjusted. Thus, not only the required firing frequency in different countries can be satisfied, but also the time in development and tolerance design can be saved significantly.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1A:
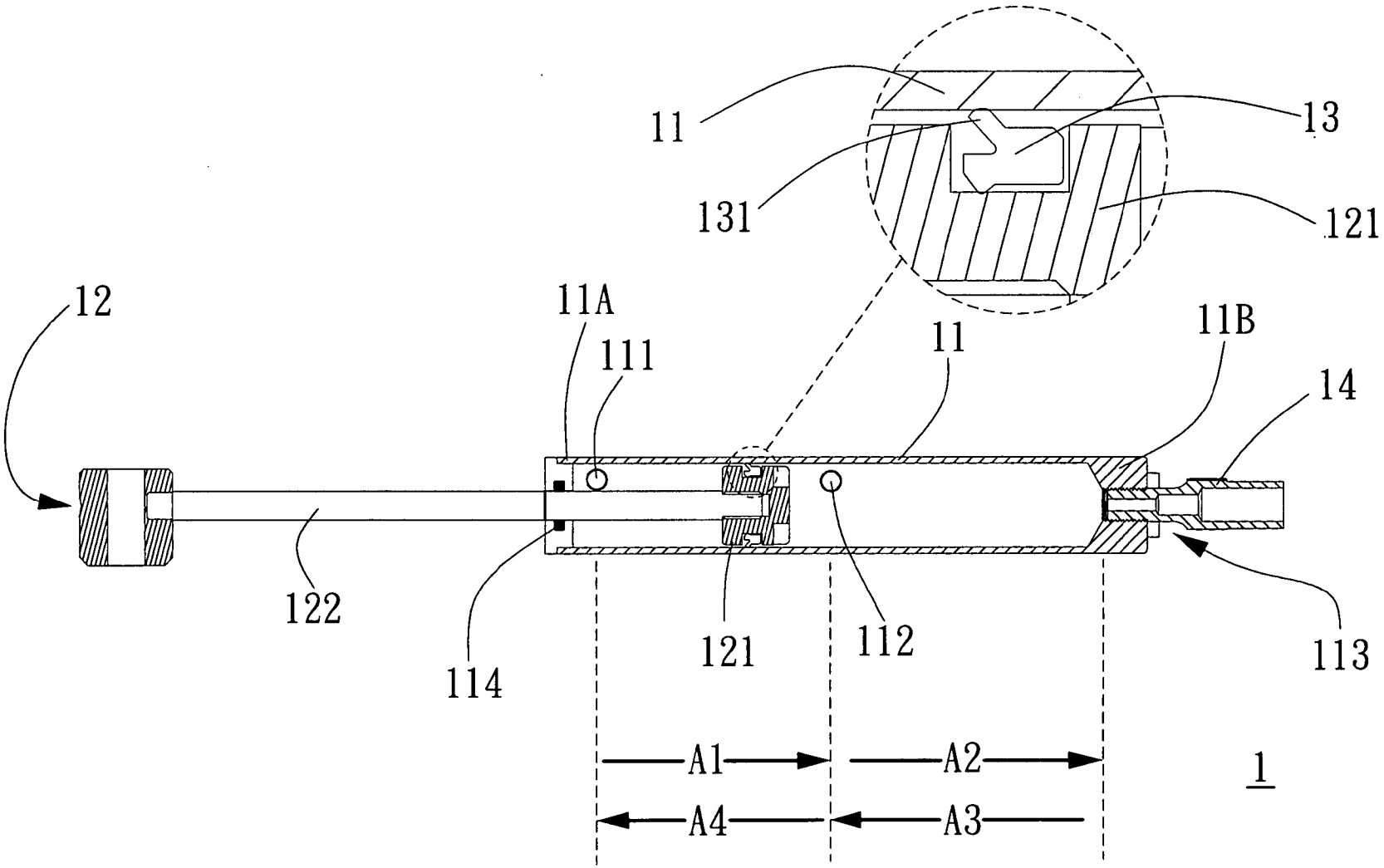
FIG. 1A is cross-sectional view of firing frequency controller of the first embodiment in present invention.
Figure 2:
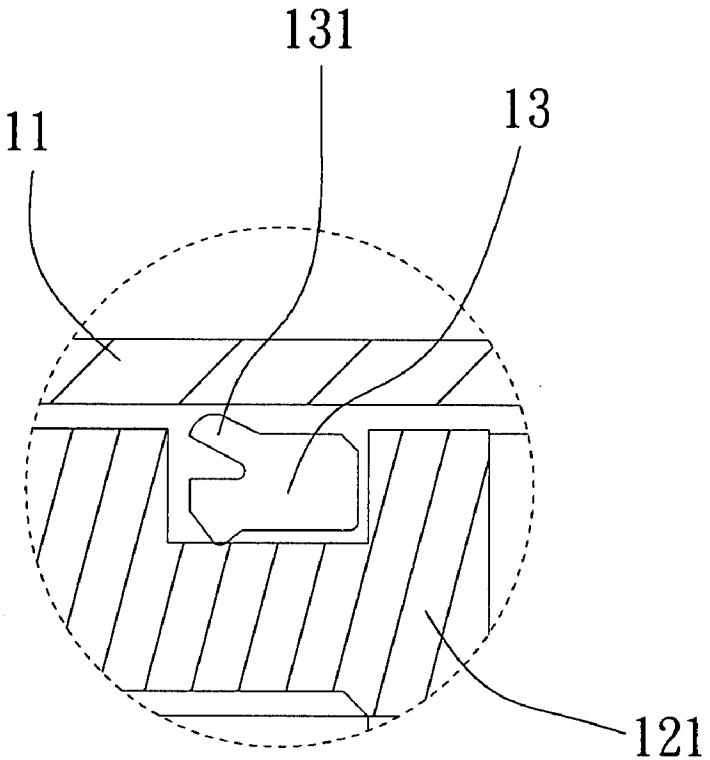
FIG. 2 is cross-sectional view of enlarged drawing of unidirectional seal at the condition of non-airtight.

Please refer to FIG. 1A, FIG. 1A is cross-sectional view of firing frequency controller of the first embodiment in present invention. The firing frequency controller 1 includes a cylinder body 11, a piston assembly 12, a unidirectional seal 13, and a flux regulator 14. The cylinder body 11 includes a first end portion 11A and a second end portion 11B. The first end portion 11A contains a first orifice 111. The first orifice 111 is disposed at the side wall of cylinder body 11. The second end portion 11B contains a third orifice 113. The third orifice 113 is disposed at the end of the cylinder body 11. The cylinder body 11 further includes a second orifice 112. The second orifice 112 is disposed at side wall of the cylinder body 11 and between the first orifice 111 and the third orifice 113. The flux regulator 14 is disposed in the third orifice 113 to regulate its gas flux. The piston assembly 12 including a piston 121 and a pole 122 is disposed inside the cylinder body 11. The piston 121 can be moved cyclically between the first end portion 11A and the second end portion 1B. The pole 122 is connected to the piston 121 with one end and is extended to the exterior of the first end portion 11A of the cylinder body 11 with another end. Additionally, the pole 122 is moved with the piston 121. Inside the cylinder body 11, the stroke from the first orifice 111 to the second orifice 112 is defined as first route A1, the stroke from the second orifice 112 to the third orifice 113 is defined as second route A2, the stroke from the third orifice 113 to the second orifice 112 is defined as third route A3, and the stroke from the second orifice 112 to the first orifice 111 is defined as fourth route A4. A first sealing element 114 is disposed at the contact area of the first end portion 11A and the pole 122. In this embodiment the first sealing element 114 is an O-ring. Because of the installation of the first sealing element 114, the air inside the cylinder body 11 will not be leaked out from the contact area of the first end portion 11A and the pole 122. The unidirectional seal 13, being annular configuration, is disposed at outside of the piston 121 and adjacent to the inner wall of the cylinder body 11. The unidirectional seal 13 includes a flexible branch 131 outside. The branch 131 can be swung along with the gas flow. As shown in FIG. 2, when the unidirectional seal 13 is moved with the piston 121 in the first route A1 and the second route A2, the gas flow will force the branch 131 to be approached to the axis (unmarked) of the unidirectional seal 13. In the meantime, the branch 131 is not contacted with the inner wall of the cylinder body 11. Therefore, the unidirectional seal 13 is open and is kept non-airtight while the piston 121 is moved in the first route A1 and the second route A2. As shown in the enlarged view of FIG. 1A, when the unidirectional seal 13 is moved with the piston 121 in the third route A3 and the fourth route A4, the gas flow will force the branch 131 to be separated from the axis of the unidirectional seal 13. In the meantime, the branch 131 is contacted with the inner wall of the cylinder body 11. Therefore, the unidirectional seal 13 is kept airtight while the piston 121 is moved in the third route A3 and the fourth route A4.

Furthermore, those skilled in the art can dispose plurality of first orifice or second orifice at the side wall of cylinder body. Or, the third orifice can be disposed at the side wall of the cylinder body. While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may be occurred to those ordinarily skilled in the art.

Figure 3A:
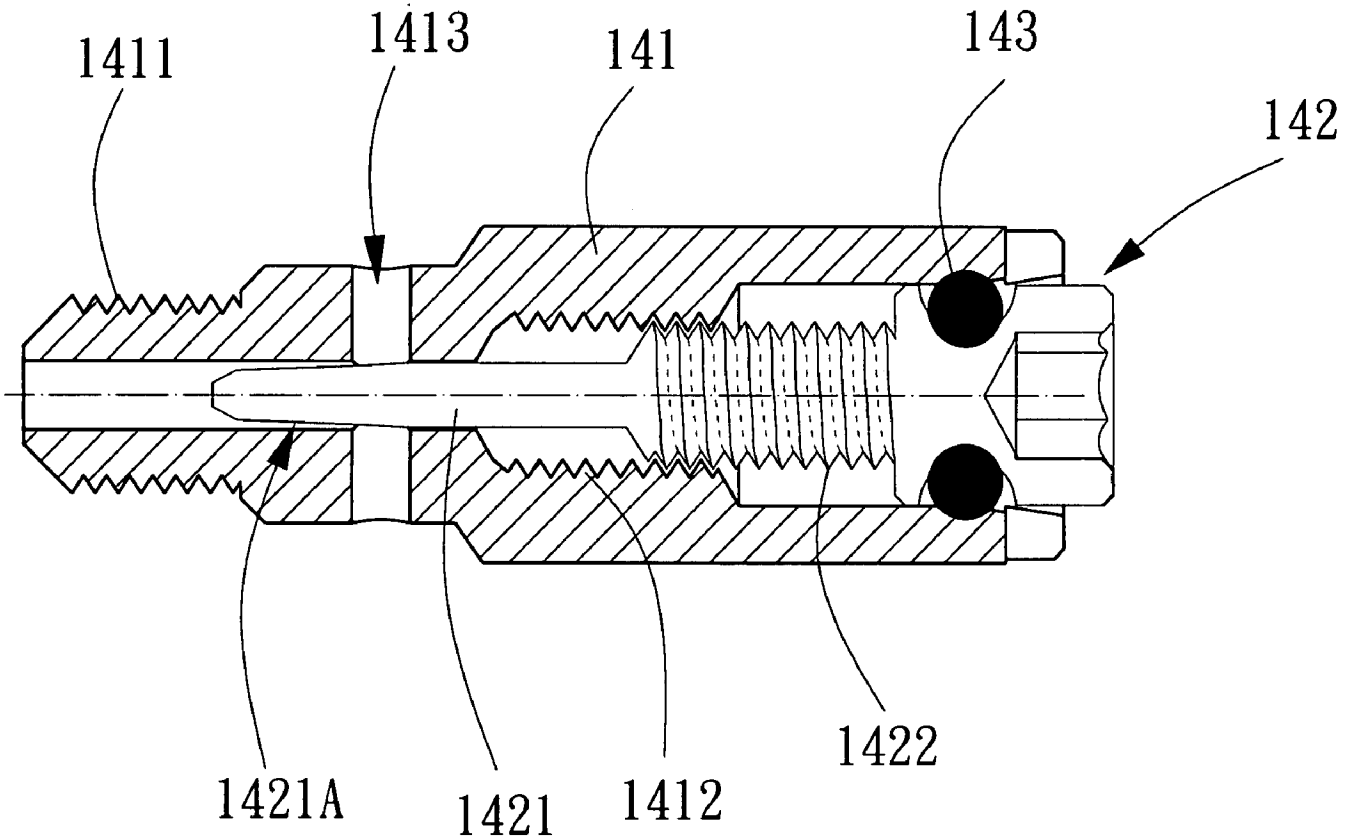
FIG. 3A is cross-sectional view of flux regulator while the flux regulator is open.
Figure 3B:
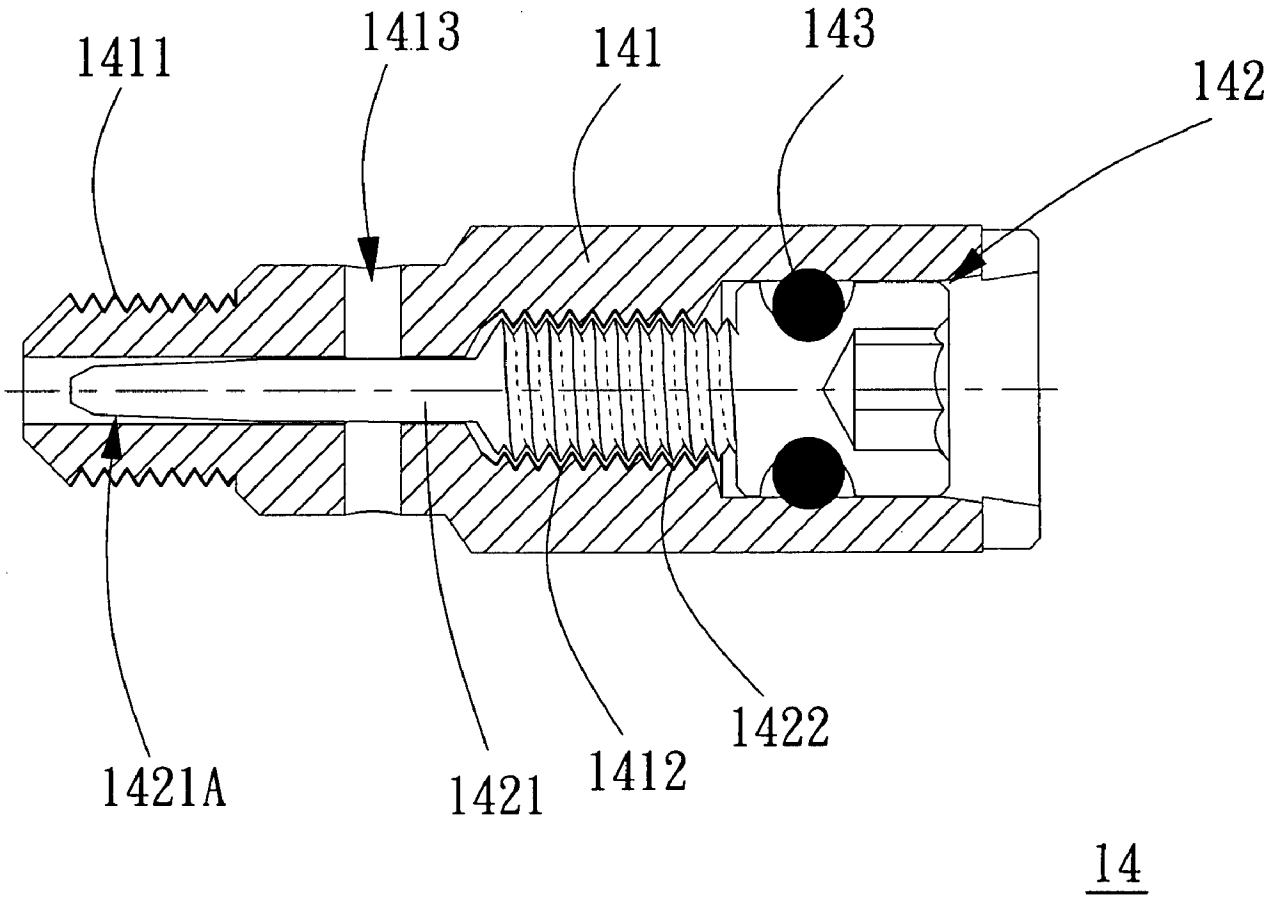
FIG. 3B is cross-sectional view of flux regulator while the flux regulator is closed.

Please refer to FIG. 3A and FIG. 3B, FIG. 3A is cross-sectional view of flux regulator while the flux regulator is open, FIG. 3B is cross-sectional view of flux regulator while the flux regulator is closed. In FIG. 3A and FIG. 3B, the flux regulator 14 includes a frame 141, a bolt 142 and a second sealing element 143. The frame 141 is a hollow cylinder and contains a first external thread 1411, an internal thread 1412 and a channel 1413. The bolt 142, disposed inside the frame 141, contains a needle-like portion 1421 and a second external thread 1422. Herein, the flux regulator 14 is screwed in the third orifice 113 with the first external thread 1411. In the flux regulator 14, the channel 1413 is through the frame 141 in radial direction and communicated with the interior of the frame 141. The needle-like portion 1421 has long length and contains an inclined surface 1421A. The second sealing element 143 is disposed at the rear end of the bolt 142 so as to isolate the interior of the frame 141 from the outside. The internal thread 1412 of the frame 141 is mated with the second external thread 1422 of the bolt 142, and thus the bolt 142 can be screwed and the needle-like portion 1421 can be moved in the longitudinal direction. When the bolt 142 is released, the gas goes through the channel 1413 and the interior of the frame 141 from the outside, and then gets into the interior of the cylinder body 11. When the bolt 142 is screwed tight, the channel 1413 will be obstructed by the needle-like portion 1421 to prevent the gas from going through. Therefore, by just screwing the bolt 142 to adjust the position of the inclined surface 1421A of the needle-like portion 1421, the user can adjust the gas flux through the third orifice 113.

Figure 4A:
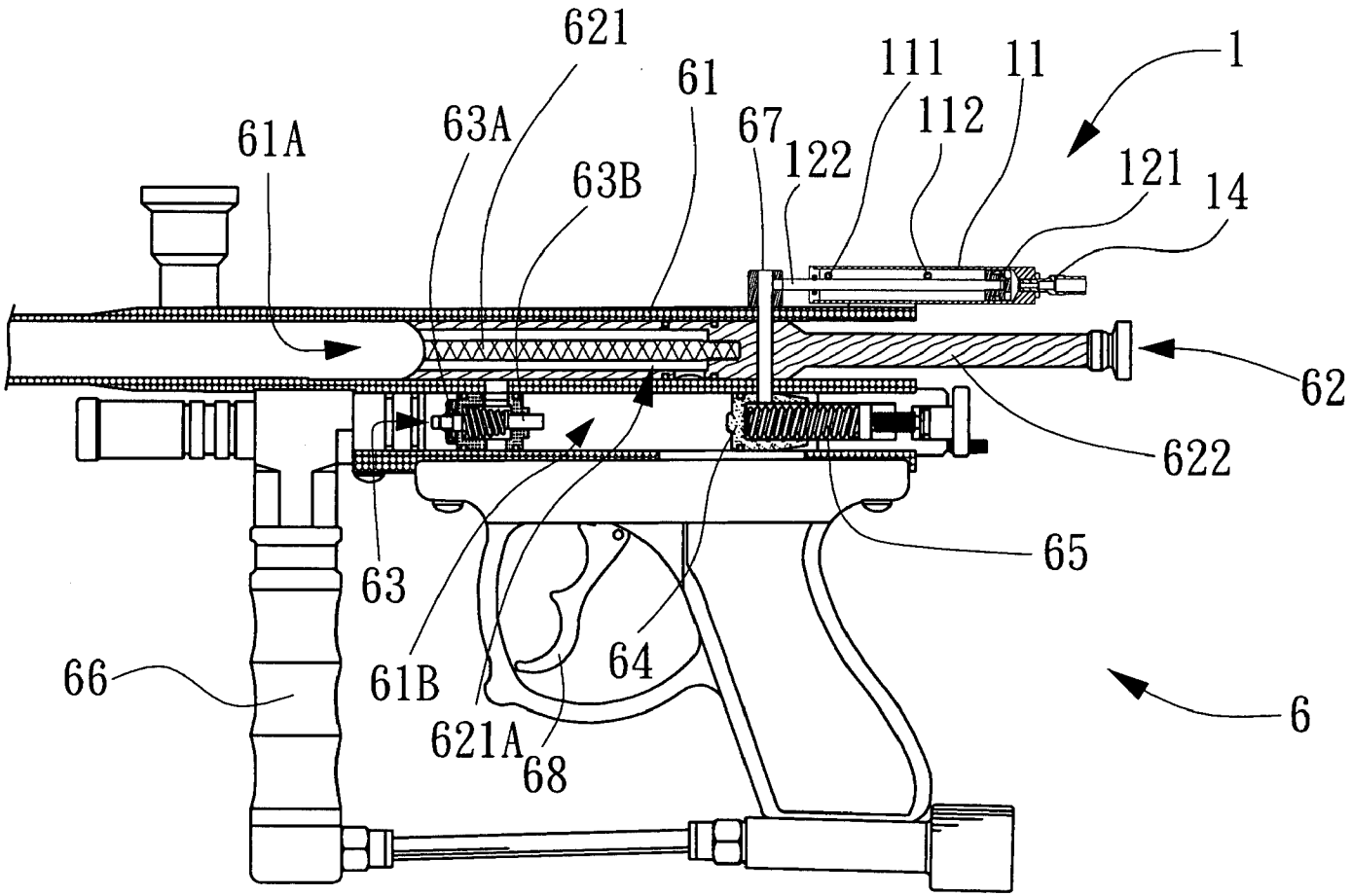
FIG. 4A is application diagram of firing frequency controller of the first embodiment before the trigger is pressed.
Figure 4B:
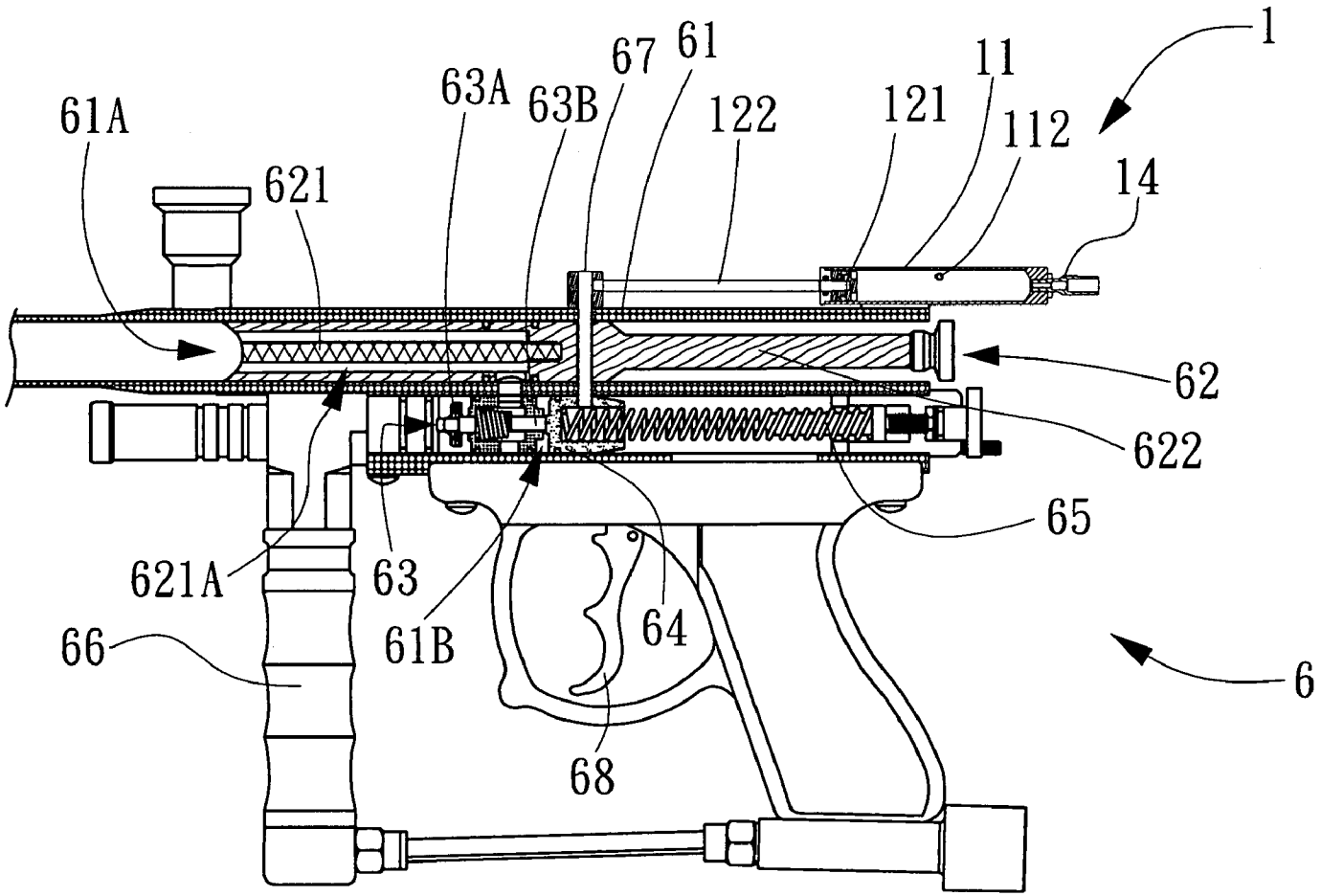
FIG. 4B is application diagram of firing frequency controller of the first embodiment after the trigger is pressed.

In order to address the detailed benefit of the present invention, a toy gun combined with aforementioned firing frequency controller is introduced. Please refer to FIGS. 1A, 4A and 4B, FIG. 4A is application diagram of firing frequency controller of the first embodiment before the trigger is pressed, FIG. 4B is application diagram of firing frequency controller of the first embodiment after the trigger is pressed. In FIGS. 4A and 4B, the firing frequency controller 1 of present invention combined with a toy gun 6 is shown. The toy gun 6 includes a barrel assembly 61. The barrel assembly 61 contains an upper tube 61A and a lower tube 61B. The upper tube 61A and the lower tube 61B are parallel. A ram 62, disposed inside the upper tube 61A, contains an actuating portion 621 in the front end. The actuating portion 621 comprising a gas tunnel 621A and said gas tunnel 621A is communicated to the lower tube 61B. The compressed gas is allowed to go through the gas tunnel 621A to push a projectile (not shown) out of the upper tube 61A. The ram 62 further contains a handle 622 in the rear end. A pipe 66 is disposed in front of the lower tube 61B. A valve 63 is disposed in the rear of the pipe 66 inside the lower tube 61B. The valve comprises a push rod 63B and a cap 63A. Herein, the push rod 63B can be pushed to open the cap 63A of the valve 63. Additionally, a striker 64 is disposed in the rear of the valve 63 and can be moved back and forth inside the lower tube 61B. A spring 65 is disposed in the rear of the striker 64. The striker 64 can be pushed forth by the spring 65. A connector 67 is disposed between the ram 62 and the striker 64. By the connector 67, the ram 62 and the striker 64 are linked together to move simultaneously. As shown in FIG. 4A, when the handle 622 is pulled backward, the ram 62 and the striker 64 will be moved backward and the toy gun 6 will be ready for percussion. In the meantime, the spring 65 is squeezed by the striker 64 and lower end of the striker 64 is stuck by a trigger 68. Besides, a projectile (not shown) will be fallen into the upper tube 61A in the same time. This is the condition of pre-percussion. As shown in FIG. 4B, after the trigger 68 is pressed, the striker 64 is released and then is pushed forward by the spring 65. In the meantime, the ram 62 is also moved forward. When the striker 64 is moved to touch the push rod 63B of the valve 63, the cap 63A is opened to allow compressed gas to flow in. Hereby, the compressed gas is released from the pipe 66, passed through the valve 63, and then gotten into the upper tube 61A. Next, the compressed gas is passed through the gas tunnel 621A around the actuating portion 621. Finally, the projectile is ejected by the compressed gas. This is the condition of after-percussion. After the projectile is ejected, compressed gas is passed through the valve 63 and then gotten into the space between the valve 63 and the striker 64 inside the lower tube 61B. In addition, the striker 64 is moved backward by compressed gas to squeeze the spring 65, and then the condition of pre-percussion will be returned. By the work of the spring 65 and the compressed gas, when the trigger 68 is pressed and released, the striker 64 and the ram 62 will be moved back and forth.

In order to adjust the firing frequency, the firing frequency controller 1 is disposed above the barrel assembly 61 and the connector 67 and the pole 122 is linked together. Thus, the striker 64, the ram 62 and the pole 122 of the firing frequency controller 1 can be moved together. After the trigger 68 is pressed, the striker 64 will be moved forward with the connector 67, the ram 62 and the piston 121. When the striker 64 and the ram 62 is moved forward, the piston 121 is in the third route A3 and the fourth route A4. In the third route A3, the branch 131 is contacted with the inner wall of the cylinder body 11 and the unidirectional seal 13 is kept airtight. Meanwhile, merely little gas is allowed to flow into or flow out of the cylinder body 11 through the flux regulator 14 disposed in the third orifice 113. Thus, the volume, between the piston 121 and the third orifice 113, is increased comparatively slower due to the pressure difference. Therefore the velocity of the piston 121 in the third route A3 becomes slower consequently. Besides, as the gas flux through the flux regulator 14 is reduced, the velocity of the piston 121 in the third route A3 becomes slower. Therefore, the velocity of the striker 64 and the ram 62 of the toy gun 6 also become slower. In the fourth route A4, because the gas around the piston 121 is communicable to the exterior through the first orifice 111 and the second orifice 112, although the unidirectional seal 13 which is disposed at outside of the piston 121 is remained to be airtight, the velocity of the piston 121 will not be retarded by pressure difference. After the projectile is ejected, the compressed gas is passed through the valve 63 and then the striker 64 is pushed by said compressed gas to move backward with the connector 67, the pole 122 and the piston 121. In the meantime, the piston 121 is in the first route A1 and second route A2, the branch 131 of the unidirectional seal 13 is not contacted with the inner wall of the cylinder body 11. Thus the unidirectional seal (13) is open and is kept non-airtight. Therefore, the velocity of the piston 121 will not be influenced by the pressure difference. In this manner, the gas flux is controlled by means of adjusting the flux regulator 14 to retard the velocity of the third route A3. Thus, the automatic firing frequency can be adjusted by the user.

Figure 1B:
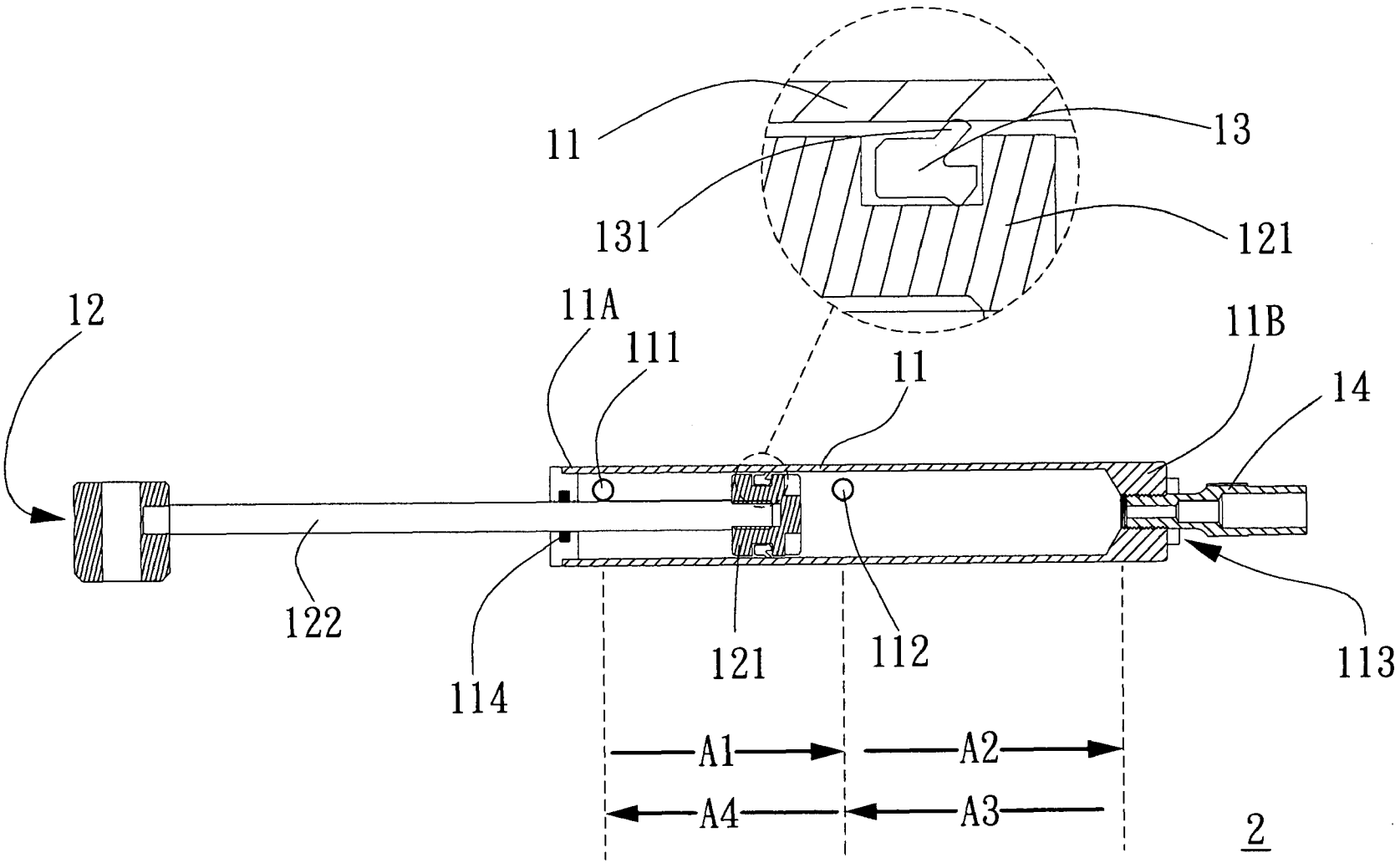
FIG. 1B is cross-sectional view of firing frequency controller of the second embodiment in present invention.

Please refer to FIG. 1B, FIG. 1B is cross-sectional view of firing frequency controller of the second embodiment in the present invention. The unidirectional seal (13) of this embodiment is inversely disposed comparative to that in FIG. 1A. Otherwise, other components in FIG. 1B are the same with that in FIG. 1A. Thus, those identical components will not be addressed again in the following description. In FIG. 1B, the unidirectional seal 13 is inverse disposed inside the firing frequency controller 2. When the unidirectional seal 13 is moved with the piston 121 in the first route A1 and the second route A2, the gas flow force the branch 131 to be separated from the axis of the unidirectional seal 13. In the meantime, the branch 131 is contacted with the inner wall of the cylinder body 11. Therefore, the unidirectional seal 13 is kept airtight while the piston 121 is moved in the first route A1 and the second route A2. When the unidirectional seal 13 is moved with the piston 121 in the third route A3 and the fourth route A4, the gas flow force the branch 131 to be approached to the axis (unmarked) of the unidirectional seal 13. In the meantime, the branch 131 is not contacted with the inner wall of the cylinder body 11. Therefore, the unidirectional seal 13 is open and is kept non-airtight while the piston 121 is moved in the third route A3 and the fourth route A4. Additionally, in the first route A1, because the gas around the piston 121 is communicable to the exterior through the first orifice 111 and the second orifice 112, although the unidirectional seal 13 which is disposed at outside of the piston 121 is remained to be airtight, the velocity of the piston 121 will not be retarded by pressure difference. In the second route A2, merely little gas is allowed to flow into or flow out of the cylinder body 11 through the flux regulator 14 disposed in the third orifice 113. Thus, the volume, between the piston 121 and the third orifice 113, is reduced comparatively slower due to the pressure difference. Therefore, the velocity of the piston 121 in the second route A2 becomes slower consequently. Besides, as the gas flux of the flux regulator 14 is reduced, the velocity of the piston 121 in the second route A2 becomes slower. In this manner, the gas flux can be controlled by means of adjusting the flux regulator 14 to retard the velocity of the second route A2. Once the firing frequency controller 2 is combined with toy guns, the automatic firing frequency can be adjusted by the user.

Figure 1C:
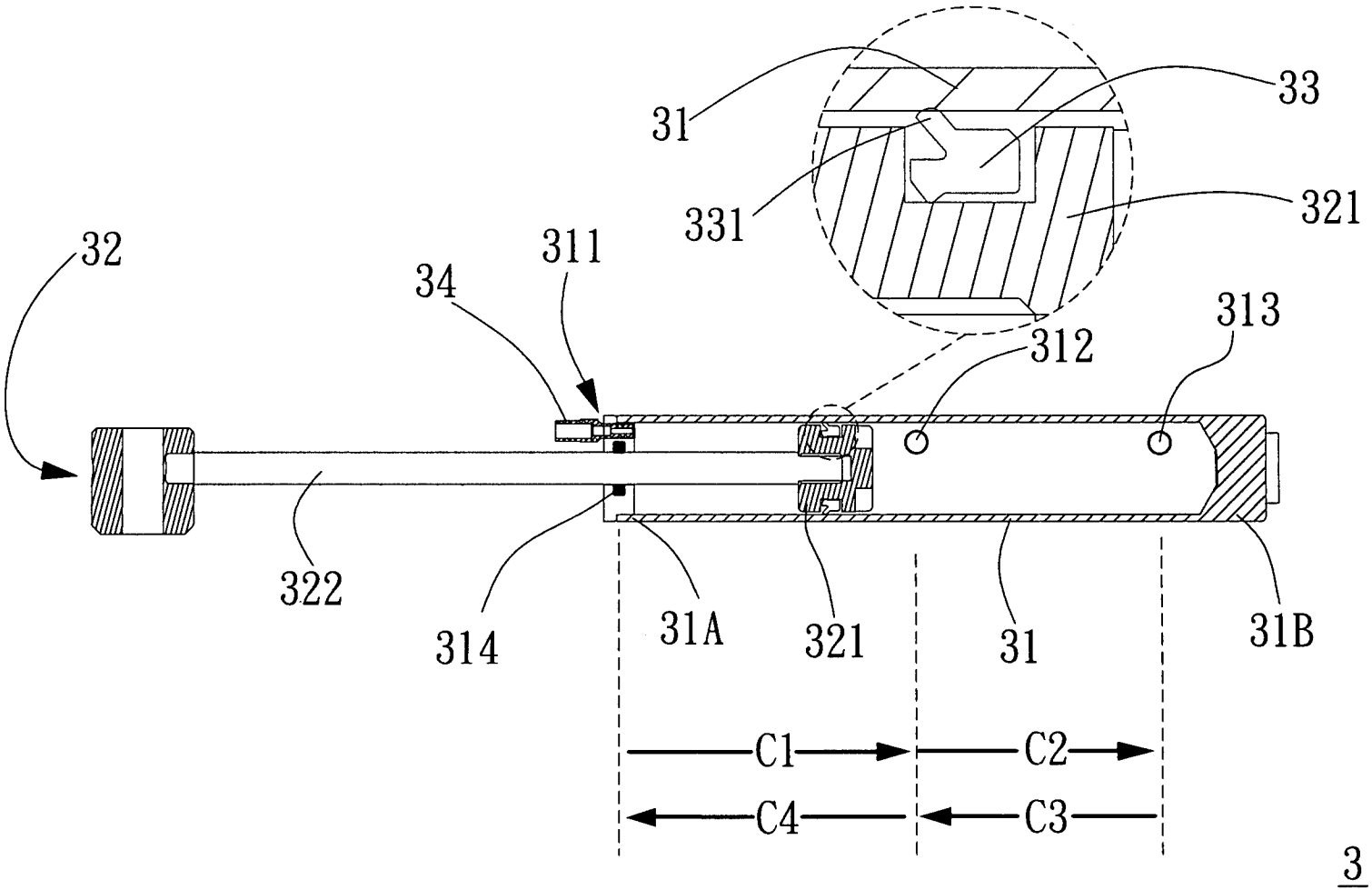
FIG. 1C is cross-sectional view of firing frequency controller of the third embodiment in present invention.

Please refer to FIG. 1C, FIG. 1C is cross-sectional view of firing frequency controller of the third embodiment in the present invention. The firing frequency controller 3 includes a cylinder body 31, a piston assembly 32, a unidirectional seal 33, and a flux regulator 34. The cylinder body 31 includes a first end portion 31A and a second end portion 31B. The first end portion 31A contains a first orifice 311. The first orifice 311 is disposed at the end of cylinder body 31. The second end portion 31B contains a third orifice 313. The third orifice 313 is disposed at the side wall of the cylinder body 31. The cylinder body 31 further includes a second orifice 312. The second orifice 312 is disposed at side wall of the cylinder body 31 and is positioned between the first orifice 311 and the third orifice 313. The flux regulator 34 is disposed in the first orifice 311 to regulate the gas flux. The piston assembly 32 is disposed inside the cylinder body 31 and includes a piston 321 and a pole 322. The piston 321 can be repeatedly moved between the first end portion 31A and the second end portion 31B. The pole 322 is connected to the piston 321 with one end and is extended to exterior of the first end portion 31A of the cylinder body 31 with another end. Additionally, the pole 322 is moved with the piston 321. The stroke from the first orifice 311 to the second orifice 312 is defined as first route C1. The stroke from the second orifice 312 to the third orifice 313 is defined as second route C2. The stroke from the third orifice 313 to the second orifice 312 is defined as third route C3. The stroke from the second orifice 312 to the first orifice 311 is defined as fourth route C4. A first sealing element 314 is disposed at the contact area of the first end portion 31A and the pole 322. The unidirectional seal 33 is disposed at outside of the piston 321 and adjacent to the inner wall of the cylinder body 31. The unidirectional seal 33 includes a flexible branch 331 disposed outside. When the unidirectional seal 33 is moved with the piston 321 in the first route C1 and the second route C2, the branch 331 is approached to the axis unmarked of the unidirectional seal 33 and thus the branch 331 is not contacted with the inner wall of the cylinder body 31. Therefore, the unidirectional seal 33 is open and is kept non-airtight while the piston 321 is moved in the first route C1 and the second route C2. When the unidirectional seal 33 is moved with the piston 321 in the third route C3 and the fourth route C4, the branch 331 is separated from the axis of the unidirectional seal 33 and thus the branch 331 is contacted with the inner wall of the cylinder body 31. Therefore, the unidirectional seal 33 is kept airtight while the piston 321 is moved in the third route C3 and the fourth route C4. Besides, in the third route C3, because the gas around the piston 321 is communicable to the exterior through the second orifice 312 and the third orifice 313, although the unidirectional seal 33 which is disposed at outside of the piston 321 is remained to be airtight, the velocity of the piston 321 will not be retarded due to pressure difference. In the fourth route C4, merely little gas is allowed to flow into or flow out of the cylinder body 31 through the flux regulator 34 disposed in the first orifice 311. Thus, the volume, between the piston 321 and the first orifice 311, is reduced comparatively slower due to pressure difference. Therefore the velocity of the piston 321 in the fourth route C4 becomes slower consequently. Besides, as the gas flux of the flux regulator 34 is reduced, the velocity of the piston 321 in the fourth route C4 becomes slower. In this manner, the gas flux can be controlled by means of adjusting the flux regulator 34 to retard the velocity of the piston in the fourth route C4.

Figure 1D:
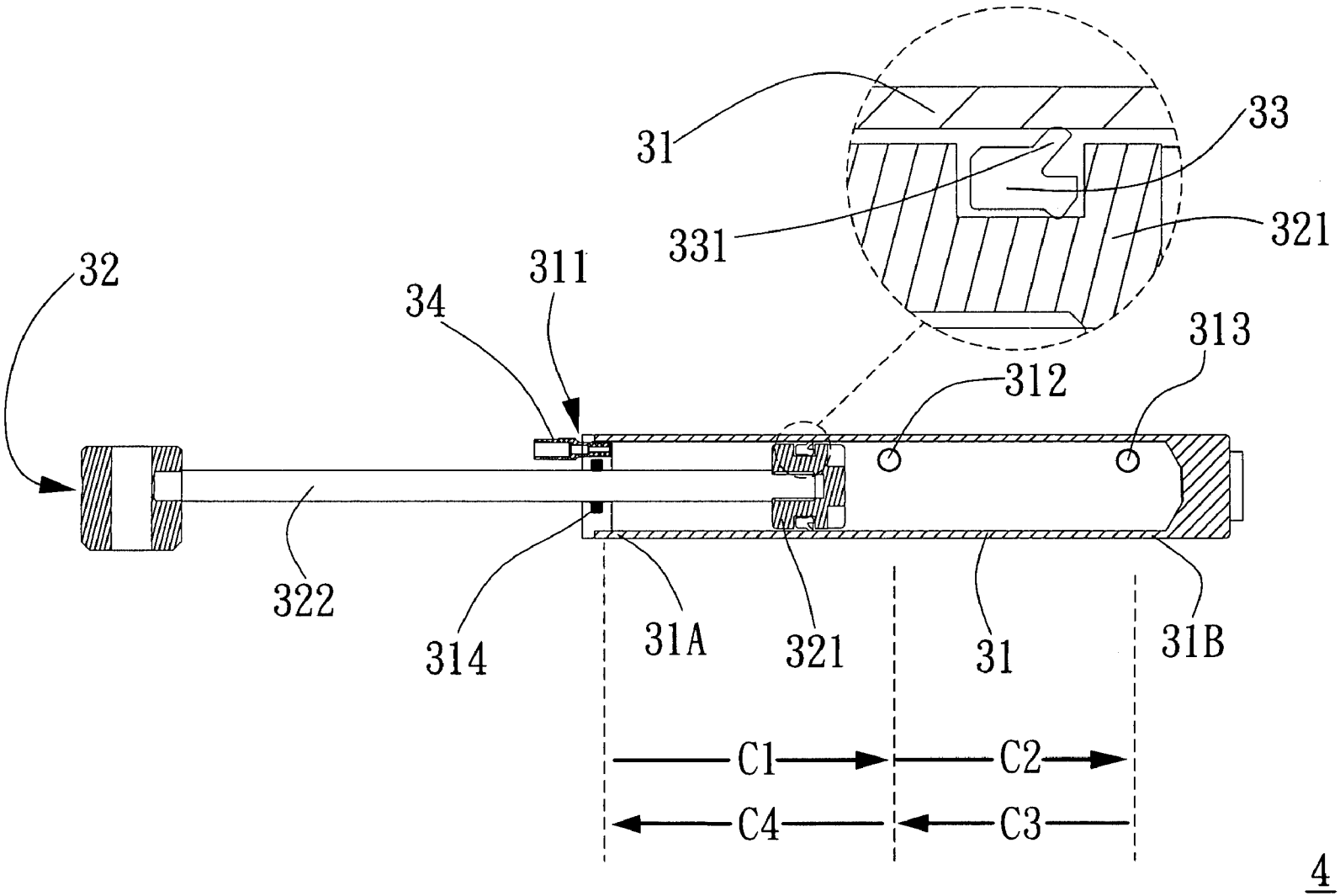
FIG. 1D is cross-sectional view of firing frequency controller of the fourth embodiment in present invention.

Please refer to FIG. 1D, FIG. 1D is cross-sectional view of firing frequency controller of the fourth embodiment in present invention. The unidirectional seal 33 of this embodiment is inverse disposed comparative to that in FIG. 1C. Other components in FIG. 1D are the same with that in FIG. 1C. Thus, those identical components will not be addressed again in the following description. In FIG. 1D, the unidirectional seal 33 is inverse disposed inside the firing frequency controller 4. When the unidirectional seal 33 is moved with the piston 321 in the first route C1 and the second route C2, the branch 331 is contacted with the inner wall of the cylinder body 31. Thus, the unidirectional seal 33 is kept airtight while the piston 321 is moved in the first route C1 and the second route C2. When the unidirectional seal 33 is moved with the piston 321 in the third route C3 and the fourth route C4, the branch 331 is not contacted with the inner wall of the cylinder body 31. Therefore, the unidirectional seal 33 is open and is kept non-airtight while the piston 321 is moved in the third route C3 and the fourth route C4. In addition, in the second route C2, because the gas around the piston 321 is communicable to the exterior through the second orifice 312 and the third orifice 313, although the unidirectional seal 33 which is disposed at outside of the piston 321 is remained to be airtight, the velocity of the piston 321 will not be retarded due to pressure difference. In the first route C1, merely little gas is allowed to flow into or flow out of the cylinder body 31 through the flux regulator 34 disposed in the first orifice 311. Thus, the volume, between the piston 321 and the first orifice 311, is increased comparatively slower due to pressure difference. Therefore the velocity of the piston 321 in the first route C1 becomes slower consequently. Besides, as the gas flux through the flux regulator 14 is reduced, the velocity of the piston 321 in the first route C1 becomes slower. In this manner, the gas flux can be controlled by means of adjusting the flux regulator 34 to retard the velocity of the piston in the first route C1.

From the description above, the flux regulator is disposed in the first orifice or in the third orifice. However, to reach similar function of previous embodiments, those skilled in the art can replace the flux regulator by adjusting the diameter of the first orifice or the third orifice to be far smaller than the diameter of the second orifice.

Figure 5:
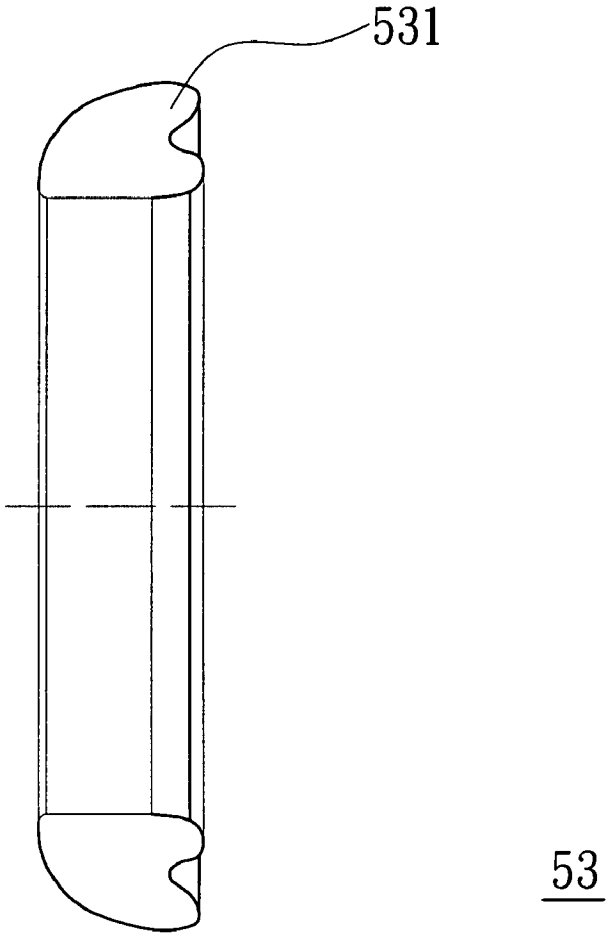
FIG. 5 is cross-sectional view of another type of unidirectional seal.

Additionally, the unidirectional seal can be designed as other configurations. Please refer to FIG. 5. FIG. 5 is cross-sectional view of another type of unidirectional seal. In FIG. 5, the unidirectional seal 53 includes a flexible branch 531. The gas flow can force the branch 531 to be contacted with or separated from the cylinder body not shown. While the cylinder body is contacted, the unidirectional seal 53 is kept airtight.

Summarily, firing frequency controller of the present invention can be accommodated to various toy guns with diversified configuration, and then the toy guns' firing frequency can be adjusted. Thus, not only the required firing frequency in different countries can be satisfied, but also the time in development and tolerance design can be saved significantly.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may occur to those ordinarily skilled in the art.

I claim:

1. A firing frequency controller, comprising:

a cylinder body including a first end portion and a second end portion, said first end portion containing a first orifice and said second end portion containing a third orifice, said cylinder body further including a second orifice disposed between said first orifice and said third orifice, the amount of the gas flux through the first orifice being not equal to that through the third orifice;

a piston assembly which is disposed inside said cylinder body including a piston and a pole, said piston being repeatedly moved between the first end portion and the second end portion, said pole being connected to the piston and extended to exterior of the first end portion of the cylinder body, the stroke from the first orifice to the second orifice being defined as first route, the stroke from the second orifice to the third orifice being defined as second route, the stroke from the third orifice to the second orifice being defined as third route, the stroke from the second orifice to the first orifice being defined as fourth route; and a unidirectional seal being disposed at outside of said piston and adjacent to the inner wall of the cylinder body;

wherein, when the piston is moved in the third route and the fourth route said unidirectional seal is contacted with the inner wall of the cylinder body and is kept airtight, when the piston is moved in the first route and the second route said unidirectional seal is not contacted with the inner wall of the cylinder body and is kept non-airtight.

2. The firing frequency controller according to claim 1, wherein the diameter of said third orifice is smaller than the diameter of said first orifice so as to keep the amount of the gas flux through the third orifice less than that through the first orifice, and then the speed of said piston in the third route becomes slower.

3. The firing frequency controller according to claim 1, wherein a flux regulator is disposed in the third orifice to regulate the gas flux and to keep the amount of the gas flux through the third orifice smaller than that through the first orifice, and then the speed of said piston in the third route becomes slower.

4. The firing frequency controller according to claim 1, wherein the diameter of said first orifice is smaller than the diameter of said third orifice so as to keep the amount of the gas flux through the first orifice smaller than that through the third orifice, and then the speed of said piston in the fourth route becomes slower.

5. The firing frequency controller according to claim 1, wherein a flux regulator is disposed in the first orifice to regulate the gas flux and to keep the amount of the gas flux through the first orifice less than that through the third orifice, and then the speed of said piston in the fourth route becomes slower.

6. The firing frequency controller according to claim 1, wherein the unidirectional seal is annular and includes a flexible branch disposed outside, along with the gas flow said branch approaches the axis of the unidirectional seal or separates from the axis of the unidirectional seal.

7. The firing frequency controller according to claim 1, wherein a first sealing element is disposed at the contact area of said first end portion and said pole.

8. A firing frequency controller, comprising:

a cylinder body including a first end portion and a second end portion, said first end portion containing a first orifice and said second end portion containing a third orifice, said cylinder body further including a second orifice disposed between said first orifice and said third orifice, the amount of the gas flux through the first orifice being not equal to that of the third orifice;

a piston assembly which is disposed inside said cylinder body including a piston and a pole, said piston being repeatedly moveable between the first end portion and the second end portion, said pole connecting to the piston and extending to exterior of the first end portion of the cylinder body, the stroke from the first orifice to the second orifice being defined as first route, the stroke from the second orifice to the third orifice being defined as second route, the stroke from the third orifice to the second orifice being defined as third route, the stroke from the second orifice to the first orifice being defined as fourth route;

a unidirectional seal being disposed at outside of said piston and adjacent to the inner wall of the cylinder body;

wherein, when the piston is moved in the first route and the second route said unidirectional seal contacts the inner wall of the cylinder body and keeps airtight, when the piston moves in the third route and the fourth route said unidirectional seal does not contact the inner wall of the cylinder body and keeps non-airtight.

9. The firing frequency controller according to claim 8, wherein the diameter of said third orifice is smaller than the diameter of said first orifice so as to keep the amount of the gas flux through the third orifice smaller than that through the first orifice, and then the speed of said piston in the second route becomes slower.

10. The firing frequency controller according to claim 8, wherein a flux regulator is disposed in the third orifice to regulate the gas flux and to keep the amount of the gas flux through the third orifice smaller than that through the first orifice, and then the speed of said piston in the second route becomes slower.

11. The firing frequency controller according to claim 8, wherein the diameter of said first orifice is smaller than the diameter of said third orifice so as to keep the amount of the gas flux through the first orifice smaller than that through the third orifice, and then the speed of said piston in the first route becomes slower.

12. The firing frequency controller according to claim 8, wherein a flux regulator is disposed in the first orifice to regulate the gas flux and to keep the amount of the gas flux through the first orifice smaller than that through the third orifice, and then the speed of said piston in the first route becomes slower.

13. The firing frequency controller according to claim 8, wherein the unidirectional seal is annular and includes a flexible branch disposed outside, along with the gas flow said branch approaches the axis of the unidirectional seal or separates from the axis of the unidirectional seal.

14. The firing frequency controller according to claim 8, wherein a first sealing element is disposed at the contact area of said first end portion and said pole.

* * * * *